United States Patent [19]

Wittnebert et al.

[11] 3,951,555

[45] Apr. 20, 1976

[54] MODULAR WRITING PEN

[75] Inventors: Frederick R. Wittnebert, Whitewater; Francis J. Meinhardt, Edgerton; Joseph R. Branks, Janesville; Gerald C. Herold, Janesville; Daniel P. Stambaugh, Janesville, all of Wis.

[73] Assignee: The Parker Pen Company, Janesville, Wis.

[22] Filed: Apr. 14, 1975

[21] Appl. No.: 567,678

[52] U.S. Cl. ..... 401/217

[51] Int. Cl.[2] ..... B43K 7/02

[58] Field of Search ..... 401/209–217, 198, 199

[56] References Cited

UNITED STATES PATENTS

| | | | |
|---|---|---|---|
| 2,880,702 | 4/1959 | Joyce | 401/209 |
| 3,399,021 | 8/1968 | Matsumoto | 401/199 |

FOREIGN PATENTS OR APPLICATIONS

| | | | |
|---|---|---|---|
| 435,349 | 3/1948 | Italy | 401/217 |
| 825,966 | 12/1951 | Germany | 401/217 |
| 464,200 | 7/1951 | Italy | 401/217 |

*Primary Examiner*—Lawrence Charles

[57] ABSTRACT

A writing pen which comprises a vacuum controlled reservoir for containing a supply of ink having a lower viscosity than conventional ball pen ink, a writing tip which may be any one of a number of interchangeable types and a finned collector including a weir and feed which are arranged to induce capillary flow of the ink from the reservoir to the tip for writing purposes.

35 Claims, 10 Drawing Figures

MODULAR WRITING PEN

BACKGROUND OF THE INVENTION

This invention relates in general to writing pens and in particular to a modular writing pen combination. The invention is modular in the sense of being comprised of modules to the extent that all of the writing pen combinations, except for a specific writing tip and ink and with a minor feed change therein, may be considered to be one module while the various writing tips may be considered other modules. This invention is considered modular being a family of modules of a broad product system. Technically this invention is a pen, however, it is intended to be a refill for use inside of a holder which together constitute a pen as commonly understood. Much of its value stems from its being a refill.

The primary objective of this invention is considered to be that of permitting a writing instrument manufacturer and marketer to provide the consumer with an array of products in a range of writing modes, such as a ball point, a soft tip, a conventional tip or other tip and a range of body or holder types which may be of different constructions, appearances, intrinsic values and prices. The products are also intended to possess certaian not-otherwise-attainable and/or desirable features such as better writing for the ball mode, a new stylus of tuf tip writing mode, writing-mode changing permissibility, a large ink supply, and servicing convenience. This invention permits a smaller total number of discrete product models than normally would be required for such an array of product characteristics — with associated operational economies, all the way from design to dealer stocking and represents more value per unit of price paid by the consumer than commonly is economically feasible in a going business situation. This invention attains the foregoing by providing a replaceable refill, that is shipped from the factory filled with an adequate supply of ink as contrasted with a permanently embodied writing instrument sub-assembly and incorporating in that refill all of the writing-related functional elements involved in a writing instrument, such as writing composition, composition storage, flow control, and leakage control means and writing tip instead of just some of such elements. The refill is designed in such a way that all of its components except the writing tip itself, and possibly the ink, will be alike and so that the overall geometry will be the same for a number of variants providing acceptable performance in a number of different modes of writing. The refill is adapted to be fitted into a number of different holders in such a way as to permit easy interchangeability and replacement of refills, anywhere from factory to field.

In the pursuit of the objects of this invention, much attention had to be addressed to the many different requirements which each element of the system places on other elements and how each such requirement can be avoided or satisfactorily met. Examples of such different requirements are that a soft tip or a conventional nib cannot be made to perform satisfactorily with a high viscosity or "thick" ink, such as is used in the conventional ball pen, because of the comparatively great flow resistance of the high viscosity ink and the absence, in the former two writing modes, of mechanical (ball rotational) means of conveying the ink to the paper and that the means of storing, controling flow of and avoiding leakage of thick inks must be different from those of low viscosity or "thin" inks, principally for flow resistance related reasons. Another requirement is that one of the more common means of storing thin ink in soft tip products is in a capillary reservoir which will not cooperate properly with a conventional nib product also using thin ink nor with a ball point. Additionally, of course, in the pursuit of the objectives of this invention, attention was addressed to opportunities for the realization of performance gains such as that a ball point, appropriately modified to work with thin ink, will "glide" over the paper more effectively and produce a more intense and legible line than will a conventional ball pen and that a "vacuum" reservoir will permit more ink capacity per unit of volume, more complete write-out of ink, and more uniform line quality throughout write-out of a soft tip or stylus tip than will a capillary reservoir. Other examples of performance gains are that a thin-walled casing of metal for the refill provides more ink capacity and increased volume of receiving a larger collector to improve ink overflow capacity for a given refill size than would be possible with the more common thick-walled, plastic casing along with no vapor loss through the metal casing walls such as normally occurs through the plastic casings and that a replaceable refill embodying the writing tip, of whatever writing mode, minimizes usage and maintenance problems arising from the unavoidable delicateness of all, and the impermanence of many types of writing tips.

As further background it should be pointed out that standard thick ink ball pens do not make a line as intense as fountain pens and other writing instruments due to inherent design limitations caused by the use of thick, that is, relatively viscous ink. Specifically, it is not practical or desirable to design a thick ink ball pen which will apply an intense line because thick ink does not dry quickly and is easily smeared on the paper and the pen will build up excess ink on the point which can be easily transferred to the user's clothing. A further disadvantage of such a design is that seepage problems and flow control problems will become serious enough to be noticed by the user. Therefore, in order to obtain good line intensities, it is more practical to use a thin or liquid ink. That is, an ink with a viscosity of 0.9 to 10 centipoise rather than an ink of 5,000 to 25,000 centipoise. The latter ink is typical for commercially available thick ink ball pens. In order to use a thin ink it is necessary to provide a different type of flow control than the ball and seat flow control means used in most presently available ball pens. Normally, a capillary reservoir system can be used that consists of compacts of synthetic fiber which hold the ink in the reservoir due to capillarity between the fiber or a vacuum reservoir system which comprises a reservoir and a collector. The reservoir in the vacuum reservoir system is a hollow, normally tubular space in the barrel of the pen which holds the ink by virtue of a slightly negative pressure. This negative pressure is created by the design of the ink passages and air control passages which connect the reservoir to the point and the collector. The collector acts as a surge tank to temporarily hold ink expelled from the reservoir due to pressure-temperature changes. It is frequently of multifin design and holds ink by capillary attraction.

SUMMARY OF THE INVENTION

It is a principal object of this invention to provide a simple and efficient writing pen.

A further object of this invention is to provide improved means to hold a free ink supply without using an interior fiberous capillary reservoir or capillary cell.

Yet another object of this invention is to provide an improved collector which takes up excess ink caused by changes in atmospheric pressure and which prevents leakage.

It is also an object of this invention to provide an improved writing instrument having a thin metal case making possible a larger interior and greater ink capacity.

A still further object of this invention is to provide a ball pen using thinner, freer-flowing liquid ink instead of the paste ink used in standard ball pens.

Yet another object of this invention is to provide a writing pen that is smoother writing and quicker starting.

An additional object of this invention is to provide manufacturing economies which are inherent in the systems approach as well as to benefit dealers from lower and more flexible inventories.

Further objects and features as well as advantages of this invention will become apparent as the following description of an illustrated embodiment thereof proceeds and is given for the purpose of disclosure and is taken in conjunction with the accompanying drawings in which like character references designate like parts throughout the several views.

DETAILED DESCRIPTION

Figures 1, 2, 5, 6:
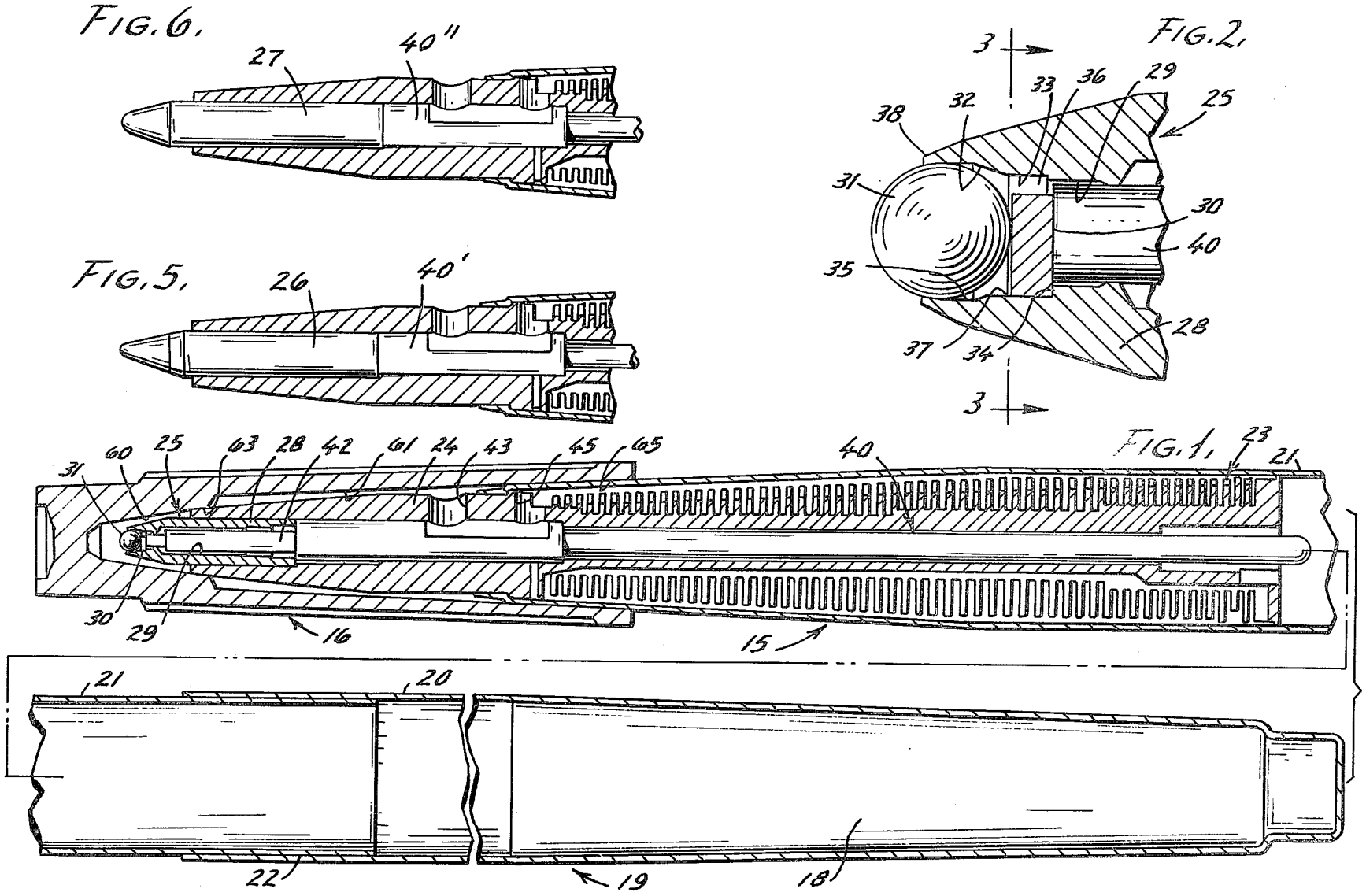
FIG. 1 is a vertical sectional view through a ball pen mode of a writing pen incorporating the principles of this invention.
FIG. 2 is a fragmentary vertical sectional view on a greatly enlarged scale showing the tip end of the writing pen shown in FIG. 1.
FIG. 5 is a fragmentary vertical sectional view, on an enlarged scale, of the tip end of a stylus mode of this invention.
FIG. 6 is a fragmentary vertical sectional view, on an enlarged scale, of the tip end of a soft tip mode of this invention.

Referring now to the several figures and first to FIG. 1 there is shown a complete writing pen or refill 15 which includes a protective cap 16 ideally made of a resilient plastic material, covering a writing end of the pen; the cap is shown connected to the pen as during shipment and storage of the pen before being used but is removable therefrom for writing with the pen. A supply of ink 18 is contained in a casing or reservoir 19 which is made up of a reservoir shell 20 and a collector shell 21 that are laser welded together at joint 22. The weld must produce a hermetic seal. During the manufacturing process the reservoir 19 is filled to approximately 95 percent of its total void capacity, including collector void volume, with thin ink having a viscosity of from 0.9 to 10 centipoise. It should be noted that the ink is loose or free to move within the reservoir. A collector 23, preferably made of a plastic material such as polyethylene, having a generally cylindrical bore therethrough is crimped inside the collector shell 21 for the storage of excess ink. The crimping of the shell 21 about the collector provides a means of creating an ink-air seal which is created by actually pushing the metal of the shell into the plastic of the collector 23. A snout or conical portion 24 of the collector 23 extends outwardly beyond the open end of the reservoir formed by shells 20 and 21. The internal dimensions of the collector bore at the outer end of the snout 24 are proportioned to enable removable mounting of any one of several modes of writing tips, some of which are shown in the drawings. FIG. 1 shows a ball point assembly 25, FIG. 5 illustrates a stylus tip 26 and FIG. 6 a soft tip wick 27. The material for the soft tip is selected to feed ink to its writing end for providing a fast-starting, broad line and for the stylus, a tough plastic is preferred having ink channels therein for delivering ink to its writing end to provide a thin, controlled line with a lighter touch.

The ball tip assembly includes a body 28 of generally cylindrical configuration having a longitudinal bore 29 therethrough, a ball retaining element or seat 30, and a ball 31. At the outer end 35 of the body 28, the bore 29 is cylindrical for a short distance and then inwardly merges to define a truncated conical bore section 32 which adjoins another smaller diameter cylindrical section 33. The cylindrical section 33 terminates at an interiorally extending step or shoulder 34. The ball 31 is mounted within the opening defined by cylindrical bore 35 and the truncated conical bore section 32 and contacts against the outer face of the ball retaining element 30. When the ball is so mounted the ball hole diameters are larger than the ball diameter. Thereafter, the forward portion of the body 28 may be spun over the ball 31 to form a lip 38 to the condition shown in FIG. 2 in order to secure the ball in place.

It is appropriate here to point out that the metering rate of a thin ink ball pen is much higher, perhaps ten times more, than a conventional thick ink ball pen and that the viscosity of the ink of a thin ink ball pen is relatively low compared with conventional ball pen ink. For these reasons a thin ink ball pen can produce a line that is more intense and bright than that of the conventional ball point design. The ball point assembly of this invention is designed to provide a surplus of ink to the equator of the ball in the area defined by the truncated conical section 32. This annular feeding of the ink results in relatively higher metering rates which provides a bright, more intense written line. The ink is carried to the paper through the space between the ball and the side of the ball socket defined by outer bore portion 35 and truncated conical bore section 32 and the flat surface of the seat 30. This side seat clearance (the diameter of the socket minus the diameter of the ball) prior to the spinning should be up to 0.0005 inches or 0.0127 millimeters. The ink flow is partially controlled by the space between the ball and the spun-over lip. This dimension of the space between the ball and the lip formed during the spinning operation is approximately up to 0.0004 inches or 0.01016 millimeters. A surplus of ink is maintained in the ball socket in back of the ball and in this invention the space for ink is approximately one-fourth the volume of the ball. This is enough ink for approximately 4 inches or 101.6 mm. of writing. The annular feed is a key element in the design of the thin ink ball pen mode of this invention.

Figure 3:
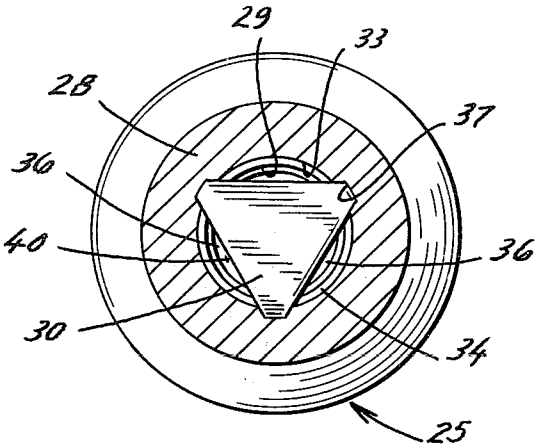
FIG. 3 is a vertical sectional view taken along the line 3—3 of FIG. 2 looking in the direction indicated by the arrows.

During writing, a component of the force applied to the ball is directed along the axis of the pen. A bearing surface is required to restrict ball movement along this axis. This can be provided by the ball retaining element or seat 30. Because the seat is made separately from the rest of the ball point assembly, more design freedom is permitted than with other means of providing an axial bearing. The inserts 30 can be made from a material different from the material of the ball making it possible to take advantage of hardness, material strength and other desirable properties. FIG. 3 illustrates a triangular-shaped seat which provides a bearing surface on the axis of the pen. It provides 3 ink channels or feed means 36 into the ball socket where the side walls of the seat are spaced from the walls of the bore in which the seat is pressed. The seat is dimensioned so that it includes side portions that are relatively larger than the diameter of section 33 so that when the seat is pressed into section 33 it displaces metal from the wall of section 33 as shown at 37 (FIGS. 2 and 3) and the seat is permanently fixed inside the ball joint assembly. When so inserted the seat 30 must have enough mechanical strength to support the ball. A slotted cylinder with 2 or more 0.005 inch or 0.127 mm. wide and 0.010 inch or 0.254 mm. deep slots could be used as a seat and could be press fitted into round holes in back of the ball socket. The end of such a cylinder would provide a bearing surface for the ball on the axis of the pen. Ink is fed through the slots on the outside of the cylinder. Other shaped inserts could be used to provide a back bearing for the writing ball and ink feed channels into variously shaped ball sockets such as a cylindrical socket illuminating truncated section 32. Such shapes include a square or rectangular insert in a round hole, an insert with 5 or more flat surfaces around its peripheries in a round hole, an insert with 3 or more points such as a star shaped inserted into a round hole, a cylindrical insert in a nonround hole such as triangular, square or others, and a ball in a nonround hole.

It is also envisioned that the body 28 of the point assembly 25 could be machined to leave a web of material separating the ball socket from the feed hole. This web could be used to provide the axial bearing surface for the ball with ink feed means provided by piercing the web. Feed holes could be punched through the web and should be located so as to leave material on the axis of the pen as a bearing surface. Each hole should have a cross sectional area equivalent to a 0.010 inch or 0.254 mm. diameter drilled hole. The shape of the hole is not critical. Feed holes could also be drilled through the web having a 0.010 inch or 0.254 mm. diameter and being located along the edge of the web so as not to interfere with the axial bearing surface. The holes can be mechanically drilled, electrodischarge machined or laser drilled.

It is preferred that the ball 31 for the point assembly of this invention have a relatively rougher surface than balls for conventional ball pens in order to obtain acceptable performance. The surface roughness is dependent on ball material. It is important that the ball maintain its surface roughness over the life of the pen in order to obtain good write-over-fingerprint performance. In general, rougher balls have less tendency to skip and may also wear the seat bearing surfaces at a higher rate. Therefore, a surface roughness, such as approximately 1.0 to 10 microinches or 0.0254 to 0.254 microns which provides adequate performance with acceptable wear is required.

The ball point assemblies of this invention are unique in that they have a relatively higher ball protrusion than conventional ball pens or competitive thin ink ball pens. This higher protrusion exposes more of the ball. It provides the ability to write at a lower angle and with a cleaner line. It also allows more axial bearing wear without impairing performance. Because this point assembly will be used in a pen with a vacuum reservoir, the pen will not lose its ink if the ball is lost as is the case with a conventional ball pen. The ball protrusion, after spin, should range between 25 and 41 percent of the ball diameter. In order to minimize the possibility of damage to the lip 38, which would affect performance, the lip thickness, after spin, should be approximately 0.001 inch or 0.0254 mm.

In order to transfer ink from the reservoir 19 to the writing tip such as the ball 31 in the ball point assembly 25, or the stylus tip 26 (FIG. 5), or the soft tip wick 27 (FIG. 6), a feed 40 is provided. The feed is mounted in the collector bore and the position of the feed 40 in the ball point assembly 25 is critical to the transfer of ink to the back of the member providing the axial bearing support. It is preferred that the end of the feed be in contact with the axial bearing member but may be spaced therefrom up to 0.005 inches or 0.1270 mm. The feed should be in the same contact arrangement in the stylus tip and soft tip wick modes. At least one dimple 39 is provided on the surface of the feed 40 to frictionally engage the surface of the collector bore for limiting rotational movement of the feed.

In order to control ink from the reservoir 19 to the writing tip, this invention includes a primary ink feed channel 41 formed in the feed 40 which extends from the supply of ink 18 in the reservoir 19 to the writing tip. The capillary strength of channel 41 is high enough to prevent breakage of the ink filament in the channel due to the negative hydraulic pressure occuring therein as a result of the opposing pulls of the capillarity of the paper during writing or of the writing tip itself when not writing and the negative pressure prevailing in the reservoir and to prevent ink leakage from the tip of the pen when the pen is subjected to high impact loads such as occur during shipping and handling. This is an appropriate time to point out that the feed 40 shown in FIGS. 1 and 7 includes a reduced, front end, cylindrical portion 42 which is proportioned to fit into the longitudinal bore 29 of the ball point assembly 25 for feeding ink to the back of the seat 30 and thereby through the ink feed channels 36 to the ball 31 for writing. The feed 40′ shown in FIG. 5 is somewhat foreshortened, as is the feed 40″ shown in FIG. 6, to feed ink directly to the back end of the stylus tip 26 and the soft tip wick 27 respectively. Referring again to FIG. 7, an exposed vent hole 43 is formed in the collector snout portion 24 and opens to the atmosphere for ingress or egress of air. In order to further transport air, the vent hole 43 connects to a connecting trough portion 44 in the feed which in turn connects to an internal vent hole 45 which in turn connects to a longitudinal air channel 50, which then connects with fin spaces 46 defined between a plurality of outwardly extending fins 47 formed in the collector 23 and an annular space 49 shown between the inside wall of the collector shell and the outside of the collector. It is important to note that the exposed vent hole 43 is connected to the internal vent hole 45 via the passage 44 so that the collector shell 21 may be crimped around the collector snout and avoid there some capillary space which might promote leakage outside the collector shell or into the protective cap if there were any ink in the collector annular space 49. A collector longitudinal air channel 50 in the connector 23 is formed through the top portion of all of the fins 47 except that there is no channel 50 portion through the second last fin away from the writing end of the pen. The air channel extends only partially into the fins. It should also be noted that the outside wall surfaces of the last three fins adjacent the reservoir are arranged to be circumferentially spaced from the inside wall of the collector shell a capillary dimension of approximately 0.0005 to 0.0065 inches or 0.013 to 0.165 mm. which is sufficiently small to maintain ink therebetween for providing an air seal and preventing air from short circuiting the intended air path through the last three fins adjacent the reservoir and except for the air channel portion 50' at the top of the third last fin and a lower air channel portion 52 formed in the bottom of the second last fin, and an upper, end fin, air channel portion 53 formed through the last fin of the collector. Thus the longitudinal air channel 50 connects to a tortuous air passage 48 serially defined through the three innermost collector fin spaces to a weir 55 which connects to the reservoir 19 through a stand-pipe or well 56 formed in the rear or inner end of the collector. Thus it is understood that the weir is in series with the air passage 48. While these last three fin spaces are called a "tortuous path" the importance is not at all that it be tortuous but that the passage 48 being in series with the weir and provide an excess-ink holding chamber having a capacity sufficient to contain any amount of ink which may be expelled from the reservoir when the pen position or attitude is changed as, for example, from the horizontal to point up to point down or the like, so that at least a majority of the ink moved into the passage 48 during attitude changes must be returned or reinjected into the reservoir when the pen attitude is returned to a normal writing position and/or when it tries to breathe atmospheric replacement air into the reservoir but before any actual breathing can take place. A narrow collector longitudinal ink feed channel 57 extends through the bottom portion of the collector fins 47 and into the central body portion of the collector.

The following discussion should be of assistance in order to fully understand the operation of the collector-feed assembly of this invention. The dimensions of the primary ink feed channel 41 in the feed 40 and of the ink passages in the various writing tips are such as to induce capillary flow of the ink 18 from the reservoir 19 to any one of the tip modes for writing purposes, and to prevent interruption of the ink filament in those passages, in the presence of a possibility of lateral ingress of air at various points along those passages caused that degree of negativity of pressure in the ink filament at such points which arises during writing as a consequence of what might be referred to as a "tug-of-war" that obtains between the capillary attraction of the ink for the paper or of the writing tip, and the prevailing negative pressure in the ink reservoir 19.

During writing, when there is no ink in the collector, the flow of ink from the reservoir to the paper reduces the amount of ink in the reservoir. Because the reservoir has rigid walls and is of constant internal volume, such depletion of ink supply tends to increase the negativity of the pressure in both the void space of the reservoir, that is the space above the ink level, and internally within the bulk of the ink itself. Such increases in the negativity of the reservoir pressure then can be lessened only by admission of air, or by an increase in reservoir temperature or by a drop in external atmospheric pressure. Ingress of air is through the weir 55.

A weir, such as the weir shown at 55, may be defined as a point, along the path of ingress of air into the reservoir, where ink from the reservoir can close off or open the air channel, according to the pressure imbalance which exists between the capillary characteristics of the controlling ink meniscus in the weir and the hydraulic pressure differential across the meniscus. The dimensions of the weir will be influenced by the surface tension of the ink, and by the advancing and receding contact angles of the ink against the surface of the weir. The dimensions of the weir, in the presence of the prevailing surface tension of a particular ink and contact angle values must be such as to cause the weir to "open" for admitting air to relieve the negativity of reservoir pressure when the negativity has become such, during the course of writeout, as to make the pressure in the ink column at the writing tip more negative than is desirable for good writing; and to cause the weir to "close" and shut off further air ingress before the reservoir pressure becomes inadequately negative to prevent excessive ink flow during writing or ink dripping from the tip when not writing. The dimensions of the weir must also provide less capillarity than that of any other possible secondary air passage into the reservoir, as through the primary ink feed channel 41 or around the periphery of the collector — so that such other passages never may inadvertently function as what might be termed "secondary" weirs; but more capillarity than obtains at any point in the air passages external to it, so as to appropriately lessen the chances of air ingress to the weir and reservoir accidentally being blocked by ink at any such point in the air passages. It should be understood that the capillary dimensions have to be adjusted to compensate for the head of ink which exists in a pen when it is written with. The weir in this invention is spaced away from the writing tip at the end of a relatively long collector structure providing a relatively large capacity for storing excess ink, in the part of the collector closely adjacent the principal ink supply in the reservoir and therefore the weir has the smallest capillary dimension within the air venting passages.

It will be noted that the principal ink channel 41 in the feed, which extends from the reservoir 19 to the writing tip, is separate from and in parallel with the ink passage 57 from the reservoir 19 to the weir 55 and beyond into spaces between the fins of the collector. This is desirable in the interest of making certain that the ink supply to the writing tip is not interrupted when the weir 55 is admitting air to the reservoir 19 and when the ink filament through the weir thereby is interrupted. The weir 55 is urged to close by the capillary strength of the ink in it (being a function of surface tension, contact angle and dimension) and the net downward pressure of the ink head above it (vertical distance to the level of ink in the reservoir × ink density minus reservoir vacuum) and is urged to open by the pressure differential between the net of the head pressure and reservoir vacuum and the outside atmosphere. This relationship may be restated to the effect that the weir will open or close according to whether the net of the in-out pressure differential is greater or less than the weir's capillary strength. This, in turn, may be translated to indicate that the weir 55, of constant capillary characteristics and for an ink of given density, will, in its opening and closing, establish an in-out pressure differential or a degree of reservoir vacuum proportional to the vertical height of the ink column above it. Because the height of ink above the weir is variable, being a function of the amount of ink in the reservoir and of the positional attitude of the unit, at any point in time, then this relationship means that the weir at such time will tend to adjust reservoir vacuum to compensate for the amount of ink in the reservoir, positional attitude atmospheric pressure and temperature by either opening, admitting air and reducing reservoir vacuum; or not opening, while ink is being withdrawn as by writing, and thus permitting an increase in reservoir vacuum. All of this means, in turn, that the weir, within the limits of its functional capability, tends to maintain the internal pressure at each point within the ink column, from writing tip to the reservoir ink level, constant and independent of degree of filling, atmospheric pressure, and temperature. Of course the internal pressure in the ink column at any such time will differ fron point to point according to ink density and vertical distance above or below any reference point, as the writing tip or weir location; and the internal pressure at all points in the ink column will change concertedly if or as the amount of ink in the reservoir, positional attitude, atmospheric pressure, or temparture change between weiring instances.

During periods of writing or non-writing, various environmental or circumstantial influences may disturb the capillary-hydraulic balance within the various structures of this invention and induce an expulsion of ink from the reservoir which would give rise to leakage if not adequately contained. The principal influences are an increase in temperature with its attendent decrease in the negativity of the reservoir pressure, a reduction at atmospheric pressure with its associated lessening of the ink-restraining outside-inside pressure differential, a change in positional attitude from less to more point-down-ness, and forwardly directed inertial effects, such as may be generated by impacts or slinging movements. An ink expelled from the reservoir under any of the above cited influences is absorbed by the fin spaces of the collector, principally by passing through the weir 55 down along the longitudinal ink feed channel 57 of the collector 23 and then parallelly into the collector fin spaces. The net force tending to urge such an ink excess into any of the collector fin spaces is the net result, positively, of the capillary force of the advancing ink front, and the head of the ink column above that front (up to the level of ink in the reservoir, according to pen attitude), and, negatively, of the prevailing outside-inside pressure differential, and ink flow resistance, if any. Obviously, any expulsion of ink from the reservoir into the collector, such as commonly occurs when reservoir pressure is inadequately negative, tends to reestablish or increase the negativity of pressure. Said otherwise: any amount of ink expelled from the reservoir, because of the inability of the prevailing negativity of reservoir pressure to support the prevailing amount of ink such as under prevailing capillary forces, positional attitude, or inertial effects will tend to restore equilibrium and to limit total expulsion by simultaneously decreasing the amount of ink in the reservoir, that is, above the weir, to be supported, and increasing the negativity of the pressure in the reservoir to the extent of the increase in reservoir void volume which has resulted from the volume of ink expelled into the collector. Any ink excess stored in the collector should be either returned to the reservoir when environmental or circumstantial influence are reversed, or be written out during subsequent periods of normal usage. Transference of ink from the collector to the writing tip is via the weir and reservoir in the illustrated invention. Obviously then, the dimensions of the collector fin spaces must be such as to provide adequate capillary strength to permit filling for tolerably small overall system imbalances, but to avoid capillary strengths sufficiently great to remain filled or preclude collector emptying. Practically, this devolves into a matter of fin space width. Because the appropriateness of the width of any fin space is related to its position in the hydraulic column (as above the writing tip or below the weir), then the width of the fin spaces should be varied in that manner (the lower the wider) and so as to be optimum when the writing pen of this invention is in a normal writing position. This is accomplished, practically, by varying the widths of groups of adjacent fin spaces.

The three innermost or uppermost fin spaces of the collector, through which the air supply of the weir must pass serially as previously indicated, are dimensioned so as to have a capillary strength moderately greater than any of the other fin spacers. This permits these spaces to maximumly attract any ink that is expelled from the reservoir and to require that the reservoir re-ingest that ink, during any subsequent period of reversed environmental or circumstantial influence before it can "breathe in" any air. Additionally, the capillary strength of the weir space is high enough to prevent ink leakage from the vent passages resulting from ink transfer from the reservoir to the collector when the pen is subjected to impact loads such as occur during shipping and handling. This feature combined with the impact leakage resistance of the primary feed channel provides the pen with leakage resistance to all but the most extreme impact loads. The net result of this tortuous path feature is to lessen the chances of the system, during a series of individually minor but cyclic environmental or circumstantial changes, repeatedly expelling ink and taking in air, if only in small increments per cycle, and eventually, thereby, loading the collector with ink so that it no longer will be capable of providing a normal degree of protection against leakage at times of major environmental or circumstantial change.

As indicated previously, the amount of ink expelled from the reservoir into the collector between weiring instances and as a consequence of changed environmental or circumstantial influences will be greater the greater the amount of void space or the less the amount of ink in the reservoir at that time. From this it can be seen that the situation most conducive to leakage is that which obtains when the amount of ink in the reservoir is just slightly in excess of the capacity of the collector; and that the collector is of minimum potential value when the reservoir is completely full of ink. And because the collector is of minimum potential value under that latter condition, then it, too, can be essentially filled with ink, as in the interest of attaining maximum total ink capacity. Accordingly, the intent is that writing pens of this invention shall be factory-filled to 95 percent or more of the combined collector and reservoir capacity. Such units may be expected first to effectively write out the amount of ink in the collector without any need for weir action and to thereafter draw ink from and admit air into the reservoir, through normal weiring.

Figure 8:
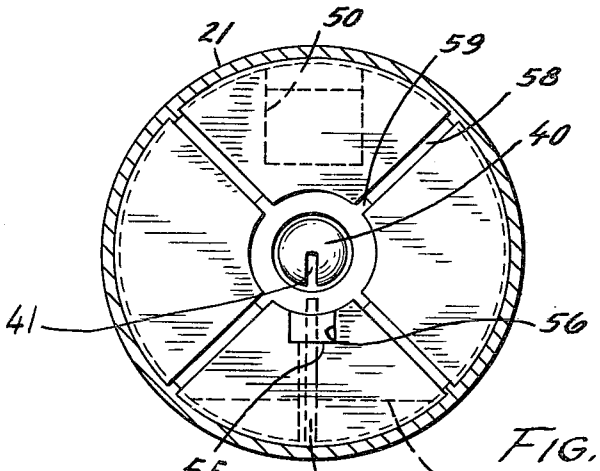
FIG. 8 is an end elevational view of the collector and feed assembly illustrated in FIG. 7.

The back wall of the collector is provided with a group of radiating capillary channels 58 (FIG. 8) which extend from the inside wall of the collector shell 21 and communicate with longitudinal capillary slots 59 formed in the face of the well 56. The radiating capillary channels 58 and longitudinal capillary slots 59 cooperate and are useful in assuring a continual supply of ink for the well 56 where the ink will be available for movement along the primary ink feed channel 41 to the writing tip. The channels 58 and slots 59 are particularly useful when there is only a small supply of ink left in the reservoir. The channels 58 radiate so that no matter what the rotational orientation of the pen, when the pen is in a relatively horizonal position, the last bit of ink will move relatively upwardly along the channel 58 which is associated with such ink. Thus these channels help use the ink supply as efficiently as possible.

Figure 4:
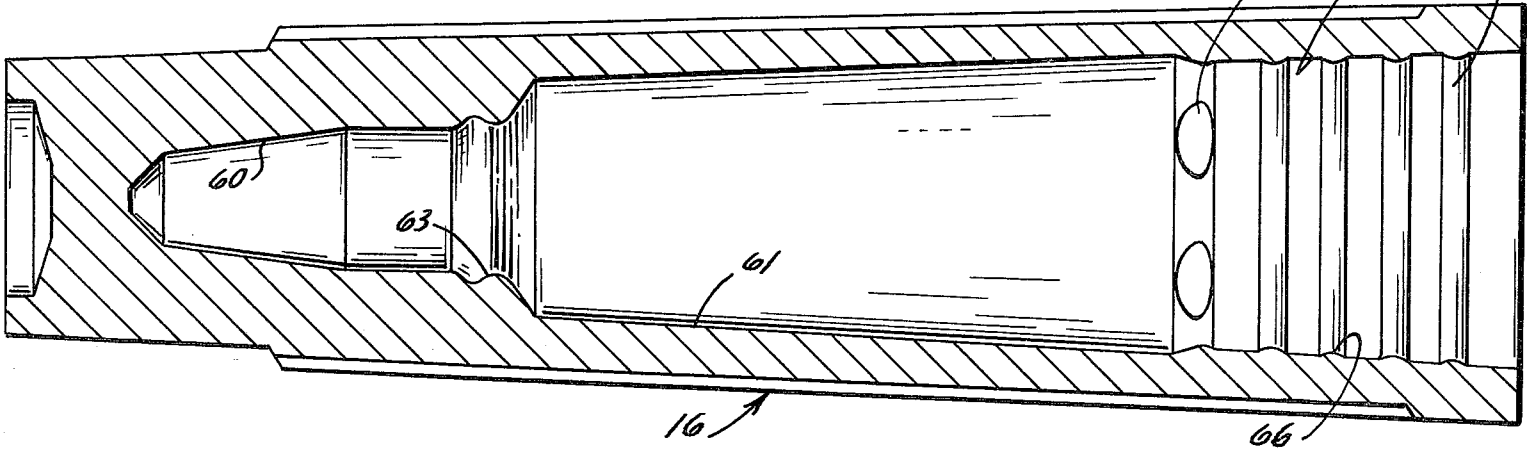
FIG. 4 is an enlarged vertical sectional view of the protective cap of this invention.

It is intended that writing pens of this invention will be shipped and stored until use with protective sealing or shipping cap 16 on the snout or front end and which is tubular and closed on one end. The cap 16 is made of a resilient material and is of multiple seal design. That is, it seals on both the metal refill shell 21 and on the collector snout 24, thus creating two different sealed compartments. These compartments (FIGS. 1 and 4) are a tip or nib compartment 60 and a vent hole compartment 61. The tip compartment 61 is sealed off by the engagement of a circumferential, inwardly extending ring seal 63 formed on the cap 16 which snugly engages around the collector snout 24 and effectively contains the writing tip of the pen. It should be pointed out that the cap now being described will work regardless of which of the writing tip modes is incorporated in the pen. The vent hole compartment 61 is closed off on one end by the sealing engagement of the ring seal 63 and snout 24 as hereinbefore described and on the outer end by a circumferential, inwardly extending sealing section 65, shown to include a series of ribs 66, which sealing engages about the collector shell 21 in such a manner that the vent hole 43 opens into the vent hole compartment 61. At the forward or inner end of sealing section 65, six inwardly extending mechanical stops 68 are arranged in a circular pattern to engage against the collector shell 21 for preventing the cap 16 from being pushed too far into the pen.

The purpose of the cap 16 is to prevent leakage of ink out of the writing end of the pen and prevent dryout of the ink. The tip compartment 60 is designed to retain any tip leakage into that area. The purpose of the vent hole compartment is to keep vent leakage ink from getting out of the cap and to avoid pulling ink out of the pen by capillary attraction which can result if a seal is imposed directly over the vent hole. A seal over the vent hole could provide a capillary passage for leakage into the snout during times when ink was in the vent trough.

The cap 16 is assembled to the pen by forcing it on with a straight axial load of approximately 10–12 pounds. During the assembly, the tip compartment seals first by design for the following reason. As the compartment seals, a positive pressure builds up which forces ink away from the compartment. With the ball point mode particularly, it is advantageous to have ink at the ball tip junction but not at the vent 43. By sealing the vent compartment 61 last, the pressure buildup forces ink away from the vent 43 and into the reservoir 19 and the tip near the ink feed channels.

Figures 7, 9, 10:
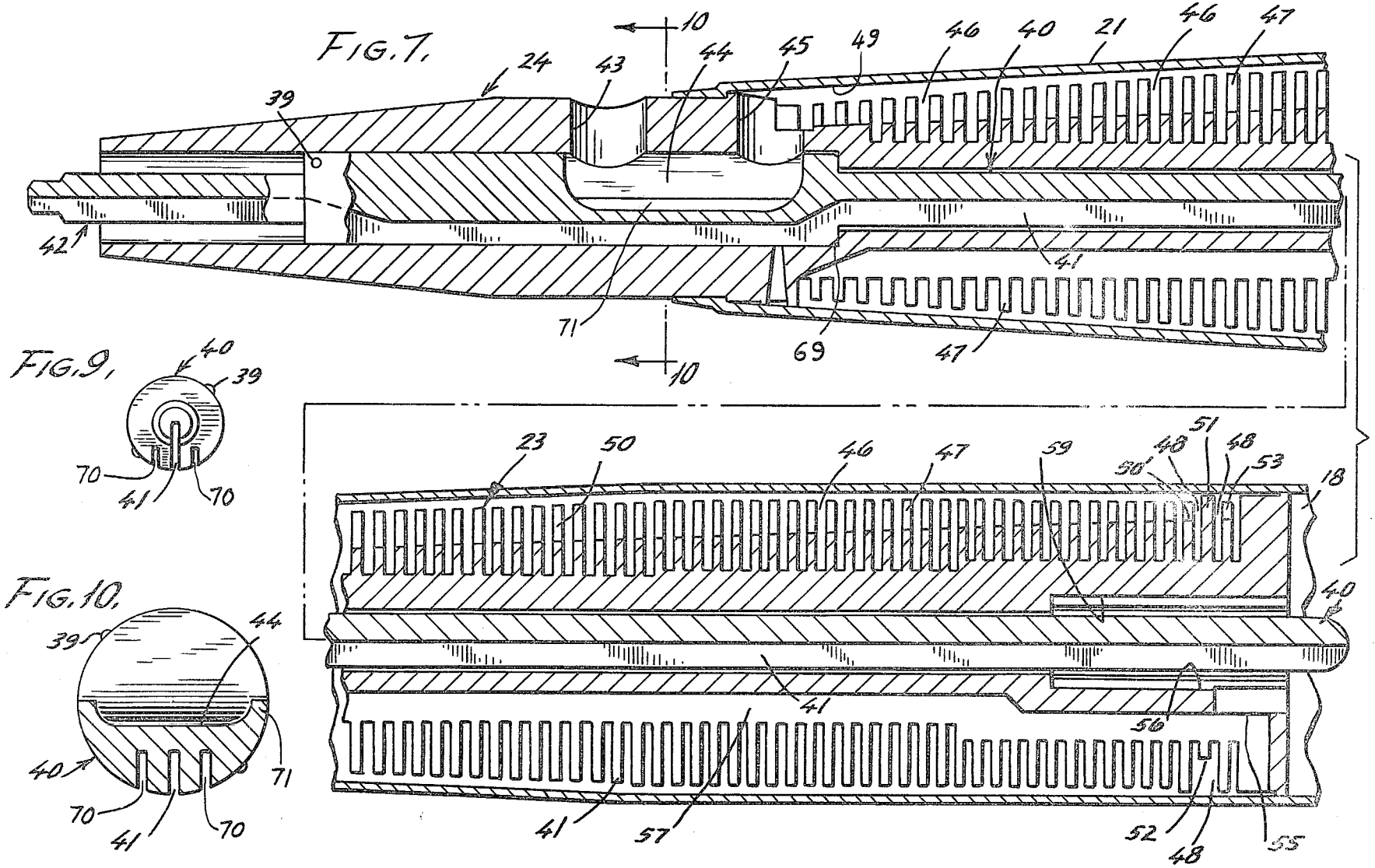
FIG. 7 is a vertical sectional view on a greatly enlarged scale showing a collector and feed assembly of the writing pen shown in FIG. 1.
FIG. 9 is an end elevational view of the feed only illustrated in FIG. 7.
FIG. 10 is a vertical sectional view of the feed only taken along the line 10—10 of FIG. 7 looking in the direction indicated by the arrows.

As shown in FIG. 7 the feed 40 includes an annular chamfer 60 which is formed in a portion of the feed that abuts a shoulder formed in the axial bore through the collector. The chamfer and the wall portions of the bore and shoulder constitute a ring path adapted for receiving a portion of the ink from the primary feed channel 41. FIGS. 9 and 10 illustrate that alternate feed channels 70 are formed in the feed 40. The alternate feed channels are adapted to receive some of the ink filling the ring path and to provide alternate paths to transport ink to whatever mode of writing tip is mounted in the pen. FIG. 10 also illustrates that webs 71 are formed of the feed along the edges of the connecting trough portion 44. The webs 71 increase the strength of the feed 40 in the vicinity of the trough and provide better air-ink sealing between the feed and the bore through the collector in that it prevents ink from capillarying from the primary ink feed channel 41 and the alternate feed channels 70 into the vent area; particularly because the webs provide more surface to seal with.

Thus, it will be appreciated that all of the recited objects, advantages and features of the present invention have been demonstrated as obtainable in a highly practical fountain pen and one that is not only simple and positive in operation, but one that is relatively inexpensive and easy to manufacture. It will be further understood that although this invention has been described with respect to certain specific embodiments thereof, it is not limited thereto, becaue various modifications of said invention will suggest themselves from the aforesaid description and one intended to be encompassed within the scope of the appended claims wherein there is claimed:

We claim:

1. A writing pen including a writing tip and a shell providing an area for storing a supply of ink, the improvement which comprises a feed extending between the ink supply area and the writing tip and a primary ink feed channel of capillary dimensions for delivering ink from the supply area to the writing tip, a collector partially mounted within the shell and partially extending from the shell and having a bore therethrough for holding the writing tip and for surrounding the feed, the portion of the collector mounted within the shell having a first set of outwardly extending fins arranged to provide capillary fin spaces therebetween, each of the first set of fins having an opening therein for providing communication between adjacent ones of the capillary fin spaces and the openings being longitudinally aligned; and the collector further having a second set of outwardly extending fins arranged to provide capillary fin spaces therebetween, the second set of fins including a tortuous air passage having a first opening communicating with the longitudinally aligned openings of the first set of fins and a second opening communicating with the ink supply area, the first and second openings in the second set of fins being circumferentially offset so that at least a portion of the tortuous air passage extends along the surfaces of the second set of fins, the outside wall surfaces of the second set of fins being circumferentially spaced from the inside wall of the shell a capillary space for maintaining ink therebetween, the collector also having an exposed vent hole in the portion of the collector extending from the shell and communicating with the atmosphere and an internal vent hole in the collector in the portion of the collector within the shell and opening into the longitudinally aligned openings along the communicating capillary fin spaces of the first set of fins and the feed comprises a trough portion arranged for connecting the exposed vent hole and the internal vent hole.

2. A writing pen as claimed in claim 1 wherein a last fin of the second set of fins is adjacent the ink supply area providing a rear wall for the collector and the collector includes a well which communicates with the air passage and the ink supply area through the rear wall of the collector, and a plurality of radiating capillary channels are formed in the rear wall for feeding ink to the well and to the ink feed channel of the feed.

3. A writing pen as claimed in claim 2 wherein the writing tip comprises a stylus tip.

4. A writing pen as claimed in claim 2 wherein the writing tip comprises a soft tip wick.

5. A writing pen as claimed in claim 2 wherein the writing tip includes a body having a longitudinal bore, a flat seat pressed into the bore and being configured to provide ink feed channels between the sides of the seat and the bore, a writing ball mounted in the bore and abutted against one of the flat surfaces of the seat, and a lip of the body being spun over the ball to retain the ball in the bore with the ball protruding outwardly beyond the lip 25 to 41 percent of the ball diameter.

6. A writing pen as claimed in claim 5 wherein an annular space for containing a supply of ink is defined between the ball, the bore and the seat and the volume of the annular space is approximately one-fourth the volume of the ball.

7. A writing pen as claimed in claim 2 further including a tubular cap closed at one end and having a first compartment defined between the closed end of the cap and a circumferential, inwardly extending ring seal adapted to sealingly engage about the portion of the collector extending from the shell, said first compartment sealing the writing tip from the atmosphere and a second compartment defined between the ring seal and at the outer end of the cap a circumferential inwardly extending sealing section adapted to sealingly engage about the shell, said second compartment sealing the exposed vent hole from the writing tip and from the atmosphere.

8. In a writing pen having a reservoir for containing a supply of ink, a finned collector mounted in the reservoir for controlling the flow of ink from the reservoir and for controlling the flow of replacement air into the reservoir, the collector including a portion extending outwardly from the reservoir and having a bore formed axially therethrough, a writing point mounted in the bore and extending forwardly from the extending portion of the collector and a feed mounted in the bore for feeding ink from the reservoir to the writing point, the improvement which comprises a first plurality of fins in the collector having longitudinally aligned openings therein and open spaces defined between adjacent fins, a communication channel defined along the longitudinally aligned openings, vent means in the collector opening into the communication channel at one end and vented to the atmosphere at the other end, and a second plurality of fins having a first opening through the fin thereof which is adjacent the first plurality of fins and connects into the communication channel, a second opening through the fin thereof which is adjacent the reservoir and connects with the reservoir, and a tortuous path for air extending from the first opening to the second opening, and spaces between adjacent ones of the fins in the second plurality of fins are dimensioned to have a capillary strength moderately greater than the capillary strength provided by the first plurality of fins.

9. A writing pen as claimed in claim 8 wherein the collector further includes a weir communicating with the tortuous path, said weir being dimensioned to admit air from the tortuous path into the reservoir for relieving negativity of reservoir pressure.

10. A writing pen as claimed in claim 9 wherein the feed includes a primary ink feed channel dimensioned to induce capillary flow of ink from the reservoir to the writing point and the collector further includes at its inner end a well which communicates with the weir and the reservoir for continually supplying ink to the primary ink feed channel even when the weir is admitting air into the reservoir from the tortuous path.

11. A writing pen as claimed in claim 10 wherein the fin of the second plurality of fins which is adjacent the reservoir provides an inside wall for the collector for containing the supply of ink and a plurality of radiating capillary channels are formed in the inside wall of the collector and extend from the well to the inside wall of the reservoir.

12. A writing pen as claimed in claim 11 wherein a plurality of longitudinal capillary slots are formed in the surface of the well and are in communication with the radiating capillary channels.

13. A writing pen as claimed in claim 12 further including a cap closed at one end and adapted to surround the writing point, the portion of the collector extending from the reservoir and a portion of the reservoir adjacent the extending collector portion and the cap being adapted to seal the writing point from the atmosphere and to seal the vent means from the writing point and from the atmosphere.

14. A writing pen as claimed in claim 13 wherein the writing point comprises a stylus tip.

15. A writing pen as claimed in claim 13 wherein the writing point comprises a soft tip wick.

16. A writing pen as claimed in claim 13 wherein the writing point comprises a ball, a cylindrical body having an axial throughbore adapted for receiving the ball at one end and a portion of the feed at the other end, and a ball retaining element partially inserted into the end of the throughbore which is adapted for receiving the ball and pressed into the material of the body, said element being triangularly-shaped with the sides of the retaining element being spaced from the wall of the throughbore for providing passage of the ink from the feed to the ball.

17. A writing pen as claimed in claim 16 wherein one end of the body is spun over to retain the ball in the throughbore and adjacent the retaining element and the ball protruding from the spun over end of the body 25 to 41 percent of the ball diameter.

18. A writing pen as claimed in claim 17 wherein an annular space is defined between the ball, the wall of the throughbore and the retaining element having a volume approximately one-fourth the volume of the ball.

19. A writing pen comprising a vacuum reservoir for storing a supply of ink, a writing tip, a feed including a primary ink feed channel having capillary dimensions adapted for feeding ink to the writing tip from the reservoir, a collector mounted partially within the reservoir and having a bore for mounting the writing tip and for surrounding the feed and having an air passageway communicating with ambient atmosphere for supplying replacement air to the reservoir as ink is written out by the tip and a weir having capillary dimensions formed in the collector adacent the reservoir and communicating with the supply of ink, the air passageway being in series with the weir and having capillary dimensions adapted for receiving any ink expelled from the reservoir through the weir during changes in pen attitude, the capillary dimensions of the primary ink feed channel being smaller than the capillary dimensions of the weir and the capillary dimensions of the weir being smaller than the capillary dimensions of the air passageway, and the capillary dimensions of the weir also restricting passage of replacement air from the air passageway into the reservoir until the expelled ink which was received into the air passageway is returned through the weir into the reservoir.

20. A writing pen as claimed in claim 19 wherein the collector comprises a first set of fins spaced for providing capillary spaces therebetween, each of the first set of fins having an opening therein with adjacent openings being aligned forming a first air passageway portion; and a second set of fins spaced for providing capillary spaces therebetween, each of the second set of fins having an opening therein forming a second air passageway portion, the openings in the second set of fins being arranged so that at least a portion of the second portion of the air passageway passes along the surfaces of adjacent ones of the second set of fins.

21. A writing pen as claimed in claim 20 wherein the second portion of the air passageway is arranged to travel in a tortuous path.

22. A writing pen as claimed in claim 21 wherein a last one of the fins of the second set of fins provides a rear wall adapted for separating the collector from the portion of the reservoir for storing ink and the weir opens through the rear wall into the reservoir.

23. A writing pen as claimed in claim 22 wherein the capillarity of the second set of fins is greater than the capillarity of the first set of fins.

24. A writing pen as claimed in claim 23 wherein the collector bore includes a well which communicates with the weir and the reservoir for continually supplying ink to the primary ink feed channel even when the weir is admitting air into the reservoir from the tortuous path.

25. A writing pen as claimed in claim 24 wherein the rear wall includes radiating capillary channels extending from the well to the inside wall of the reservoir.

26. A writing pen as claimed in claim 25 wherein the surface of the well includes capillary slots connecting with the radiating capillary channels.

27. A writing pen as claimed in claim 26 wherein the portion of the collector which extends from the reservoir includes an exposed vent hole communicating with the atmosphere and the portion of the collector within the reservoir includes an internal vent hole communicating with the first portion of the air passageway, the feed includes a longitudinal trough for uniting the exposed vent hole and the internal vent hole.

28. A writing pen as claimed in claim 27 wherein integral webs are formed of the feed material along both edges of the longitudinal trough.

29. A writing pen as claimed in claim 28 wherein at least one dimple extends outwardly of the feed into engagement against the inside of the bore through the collector for holding the feed against rotation in the bore and connectively align the longitudinal trough with the exposed vent hole and the internal vent hole.

30. A writing pen as claimed in claim 29 wherein the writing tip comprises a stylus tip.

31. A writing pen as claimed in claim 29 wherein the writing tip comprises a soft tip wick.

32. A writing pen as claimed in claim 29 wherein the writing tip comprises a ball, a body adapted to be received in the collector bore and having an axial throughbore adapted at one end for receiving the ball and at the other end for receiving a portion of the feed, and a ball retaining element inserted into the end of the throughbore which is adapted for receiving the ball and pressed into the material of the body, said ball retaining element having geometrically-shaped sides spaced from the wall of the throughbore for providing passage of the ink from the feed to the ball.

33. A writing pen as claimed in claim 32 wherein the end of the body into which the ball is received is spun over for retaining the ball in the throughbore and against the retaining element and the portion of the ball protruding from the spun over end of the body is approximately 25 to 41 percent of the ball diameter.

34. A writing pen as claimed in claim 33 wherein an annular space having a volume approximately one-fourth the volume of the ball is defined between the ball, the wall of the throughbore and the retaining element.

35. A writing pen as claimed in claim 29 further including a resilient cap having a closed end and an open end and comprising an inwardly extending ring seal adapted to sealing engage about the portion of the collector which extends from the reservoir at a position between the writing tip and the exposed vent hole for defining a first compartment sealed from the atmosphere for containing the writing tip and an inwardly extending sealing section adjacent the open end of the cap and adapted to sealing engage about the reservoir for feeding a second compartment sealed from the atmosphere, said second compartment being between the ring seal and the sealing section and the inside wall of the cap within the second compartment being spaced from the surface of the contained portions of the collector and the reservoir and being adapted to open the exposed vent hole to the interior of the second compartment.

* * * * *

UNITED STATES PATENT OFFICE

CERTIFICATE OF CORRECTION

Patent No. 3,951,555 Dated April 20, 1976

Inventor(s) F. R. Wittnebert et al.

It is certified that error appears in the above-identified patent and that said Letters Patent are hereby corrected as shown below:

Column 5, line 34
"joint" should be -- point

Column 10, line 48
"to impact loads" should be -- to high impact loads

Column 11, line 60
"into" should be -- "onto"

Column 12, line 2
"into" should be -- "onto"

Column 12, line 16
"60" should be -- "69"

Column 12, line 53
"the writing tip and a primary ink feed" should be
-- the writing tip having a primary ink feed Signed and Sealed this Twenty-first Day of September 1976

[SEAL]

*Attest:*

RUTH C. MASON
*Attesting Officer*

C. MARSHALL DANN
*Commissioner of Patents and Trademarks*